US011247352B2

(12) United States Patent
Kim

(10) Patent No.: US 11,247,352 B2
(45) Date of Patent: Feb. 15, 2022

(54) NOSE HAIR CUTTER

(71) Applicant: ROYAL METAL INDUSTRIAL CO., LTD, Bucheon-si (KR)

(72) Inventor: Gab-Soo Kim, Bucheon-si (KR)

(73) Assignee: ROYAL METAL INDUSTRIAL CO., LTD, Bucheon-si (KR)

( * ) Notice: Subject to any disclaimer, the term of this patent is extended or adjusted under 35 U.S.C. 154(b) by 0 days.

(21) Appl. No.: 17/170,746

(22) Filed: Feb. 8, 2021

(65) Prior Publication Data

US 2021/0276207 A1 Sep. 9, 2021

(30) Foreign Application Priority Data

Mar. 3, 2020 (KR) ..... 10-2020-0026575

(51) Int. Cl.
*B26B 19/14* (2006.01)

(52) U.S. Cl.
CPC ..... *B26B 19/148* (2013.01); *B26B 19/141* (2013.01)

(58) Field of Classification Search
CPC ..... B26B 19/148; B26B 19/14; B26B 19/141; B26B 19/143; B26B 19/145; B26B 19/146
USPC ..... 30/29.5
See application file for complete search history.

(56) References Cited

U.S. PATENT DOCUMENTS 2,111,861 A * 3/1938 Knapp ..... B26B 19/148 30/29.5
4,571,827 A * 2/1986 Lee ..... B26B 19/148 30/29.5
5,255,437 A * 10/1993 Chen ..... B26B 19/148 30/263
5,655,301 A * 8/1997 Dickson ..... B26B 19/148 29/428
7,013,566 B1 * 3/2006 Bellm ..... B26B 19/148 30/29.5
2016/0082608 A1 * 3/2016 Li ..... B26B 19/148 30/29.5

FOREIGN PATENT DOCUMENTS

KR 20-1989-0004257 * 4/1989
KR 10-2002-0093661 * 12/2002
KR 10-2017-0104747 * 11/2017
KR 10-2018-0106655 * 10/2018

* cited by examiner

*Primary Examiner* — Phong H Nguyen
(74) *Attorney, Agent, or Firm* — Steven M. Shape; Dennemeyer & Associates, LLC

(57) ABSTRACT

A nose hair clipper including a stationary external cylindrical body, having an external cutting portion with a plurality of first cutting edges, a plurality of first slits, and a plurality of rounded portions; a rotatable internal cylindrical body, having an internal cutting portion with a plurality of second cutting edges and a plurality of second slits, a convex portion, and a circumferential concave groove, the rotatable internal cylindrical body being inserted into the stationary external cylindrical body, and the plurality of rounded portions of the external cutting portion extending upward to be higher than an upper end of the internal cutting portion by a to predetermined gap; a bolt, screwed into the circumferential concave groove; a handling body, combined with a lower end of the rotatable internal cylindrical body; and an auxiliary cap with a brush and a driver, connected to a lower end of the handling body.

4 Claims, 20 Drawing Sheets

Fig.1 (PRIOR ART)

Fig.2 (PRIOR ART)

Fig.3 (PRIOR ART)

Fig.4 (PRIOR ART)

Fig.5 (PRIOR ART)

Fig.6 (PRIOR ART)

NOSE HAIR CUTTER

CROSS REFERENCE TO RELATED APPLICATION

The present application claims priority to Korean Patent Application No. 10-2020-026575, filed Mar. 3, 2020, the entire contents of which is incorporated herein for all purposes by this reference.

BACKGROUND OF THE INVENTION

Field of the Invention

The present disclosure relates to a nose hair clipper and, more particularly, to a nose hair clipper in which the structure of a cutting portion is optimally designed, considering the technology disclosed in Korean Patent No. 1795626 owned by the present applicant, thereby remarkably increasing the cutting performance of the nose hair clipper.

Description of the Related Art

People cut their nose hairs growing with time in a barber shop or a beauty parlor or by themselves. In most cases, nose hairs are cut with small scissors. The use of the scissors may cause discomfort to a user and may cause an injury to the user's nostrils. Some care should be exercised to prevent bacterial infections due to the injury.

In addition, a motor-driven device that rotates a cutting edge to cut nose hair has disadvantages of frequent malfunctioning and battery replacement. The nose hairs are difficult to efficiently cut with the motor-driven device because the nose hairs grow irregularly in different directions.

Moreover, typical vibrations that occur in a nose hair clipper's motor driving the cutting edge causes a cough and nasal discharge, thereby causing discomfort to the user. While the nose clipper operates, a foreign material is introduced into the nose hair clipper.

Therefore, when the nose hairs are not neatly cut, or when the nose hair clipper is not frequently cleaned, odor comes from the nose hair clipper and bacteria grow therein. The nose hair clipper has the disadvantage of being unhygienic.

In the technology disclosed in Korean Utility Model Application Publication No. 20-1989-0004257 directed to the nose hair clipper, a stationary cylindrical body and a rotating cylindrical body are inserted into a support cylindrical body, saw-toothed cutting edges of the stationary cylindrical body and the rotating cylindrical body are formed, and a handle is attached below the rotating cylindrical body. This disclosed technology has a disadvantage in that, in a case where nose hairs are introduced into the nose hair clipper or a hollow portion therein, the nose hairs are not cut.

In addition, in the technology disclosed in Korean Patent Application Publication No. 10-2002-0093661, an internal cutting edge is rotated inside an external cutting edge to cut nose hairs, and a rotation shaft of the internal cutting edge is rotated with a user's thumb and forefinger while a rear portion of a body of a nose hair clipper is held with the user's other three fingers. This disclosed technology has a disadvantage of being inconvenient to use. In the technology disclosed in Korean Patent Application Publication No. 10-2018-0106655, a cutting edge is rotated with a rotational force of a spring. This disclosed technology has a disadvantage of being difficult to apply in real life.

The foregoing is intended merely to aid in the understanding of the background of the present disclosure, and is not intended to mean that the present disclosure falls within the purview of the related art that is already known to those skilled in the art.

DOCUMENT OF RELATED ART (Patent Document 1) Korean Utility Model Application Publication No. 20-1989-0004257 (Apr. 17, 1989) titled "NOSE HAIR CUTTER"

(Patent Document 2) Korean Patent Application Publication No. 10-2002-0093661 (Dec. 16, 2002) titled "NOSE HAIR TRIMMER"

(Patent Document 3) Korean Patent Application Publication No. 10-2018-0106655 (Oct. 1, 2018) titled "NOSE HAIR CUTTER"

(Patent Document 4) Korean Patent No. 10-1795626 (Nov. 2, 2017) titled "VIBRISSA CUTTER"

SUMMARY OF THE INVENTION

An objective of the present disclosure is to provide a nose hair clipper in which structures of external and internal cutting portions formed circumferentially on upper ends, respectively, of a stationary external cylindrical body and a rotatable internal cylindrical body are optimally designed and in which an auxiliary cap having various functions is provided on a handling body constituting a main body of the nose hair clipper. The nose hair clipper thus provides higher performance than that in the related art.

According to an aspect of the present disclosure, there is provided a nose hair clipper including a stationary external cylindrical body having an external cutting portion and a rotatable internal cylindrical body having an internal cutting portion, the external cutting portion being formed circumferentially on an upper end of the external cylindrical body and having a plurality of first cutting edges and a plurality of first slits, and the internal cutting portion being formed circumferentially on an upper end of the internal cylindrical body and having a plurality of second cutting edges and a plurality of second slits, wherein the internal cylindrical body is inserted into the external cylindrical body such that the external cutting portion and the internal cutting portion correspond to each other, and when the internal cylindrical body is rotated relative to the external cylindrical body in a state in which the first cutting edges and the first slits of the external cutting portion are aligned with the second cutting edges and the second slits of the internal cutting portion, respectively, nose hairs are cut by the first cutting edges and the second cutting edges, wherein the external cutting portion of the stationary external cylindrical body has a plurality of rounded portions on an upper leading end thereof, the plurality of rounded portions extending upward to be higher than an upper leading end of the internal cutting portion of the rotatable internal cylindrical body by a predetermined gap, the second cutting edges and the second slits of the internal cutting portion are arranged in such a manner as to face each other, and internal inclination surfaces of the second cutting edges are linearly connected to a surface of a convex portion formed upward from a bottom of the internal cutting portion, lower inclination surfaces of the plurality of first slits in the external cutting portion are arranged blow the convex portion of the internal cutting portion, so that nose hairs are introduced through the plurality of second slits, are guided toward the convex portion, and, when the rotatable internal cylindrical body is rotated, the nose hairs are cut by the plurality of first cutting edges and the plurality of the second cutting edges, a bolt is screwed through the stationary external cylindrical body into a circumferential concave groove of the rotatable internal cylindrical body to fasten the stationary external cylindrical body and the rotatable internal cylindrical body to each other, the bolt being buried in the stationary external cylindrical body without protruding from a circumferential surface thereof, and an auxiliary cap having a brush and a driver is connected by a screw engagement manner to a lower end of a handling body formed on a lower end of the rotatable internal cylindrical body.

In the nose hair clipper, the number of the plurality of first slits in the stationary external cylindrical body may be 12, and the number of the plurality of second slits in the rotatable internal cylindrical body may be 9, and the upper leading end and the internal inclination surfaces of the internal cutting portion constituting the rotatable internal cylindrical body may be linearly connected with a rounded portion interposed therebetween.

In the nose hair clipper, the brush may be integrally buried in the auxiliary cap, a cylindrical body on which an insertion portion is formed may be held by being inserted into the auxiliary cap, and the driver may be held by being inserted into a through-hole formed in a center portion of a bottom surface of the auxiliary cap.

In the nose hair clipper, a permanent magnet may be buried in a lower portion of the cylindrical body.

According to the present disclosure, the rounded portion is formed on the upper leading end of the stationary external cylindrical body constituting a main body of the nose hair clipper. Thus, the nose hairs are easier to introduce at one time into a groove than in the previously employed structure in which the upper end portion of the stationary external cylindrical body is angular. This does not repulse the user.

In addition, the upper leading end of the stationary external cylindrical body extends upward to be higher than the upper leading end of the internal cutting portion of the rotatable internal cylindrical body by the predetermined gap. Accordingly, the nose hairs are first blocked by an internal surface of a groove and thus go down. Subsequently, the nose hairs are introduced toward a curved portion. A lower end portion of the inclination surface is formed relatively widely, and thus the nose hairs are cut smoothly.

Moreover, the bolt fastening the stationary external cylindrical body and the rotatable internal cylindrical body to each other does not protrude from the circumferential surface of the stationary external cylindrical body. Thus, the appearance of the nose hair clipper is not spoiled, and, while the nose hair clipper is in use, the inconvenience is not caused to the user. The auxiliary cap including the brush and the driver is mounted on the lower end of the handling body of the nose hair clipper. Thus, the stationary external cylindrical body can be easily separated from the rotatable internal cylindrical body when the cutting portions need to be cleaned or whenever necessary for any other reason.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

A preferred embodiment of the present disclosure will be described in more detail below with reference to the accompanying drawings. Specific structures and functions of the embodiment are examples of structural features thereof. The present disclosure is not limited to the embodiment described in the present specification.

First, the preferred embodiment of the present disclosure will be described below in association with the technology disclosed in Korean Patent No. 1795626. Along with the problems with the disclosed technology, configurations and operational advantages of the present disclosure will be described.

Figure 1:
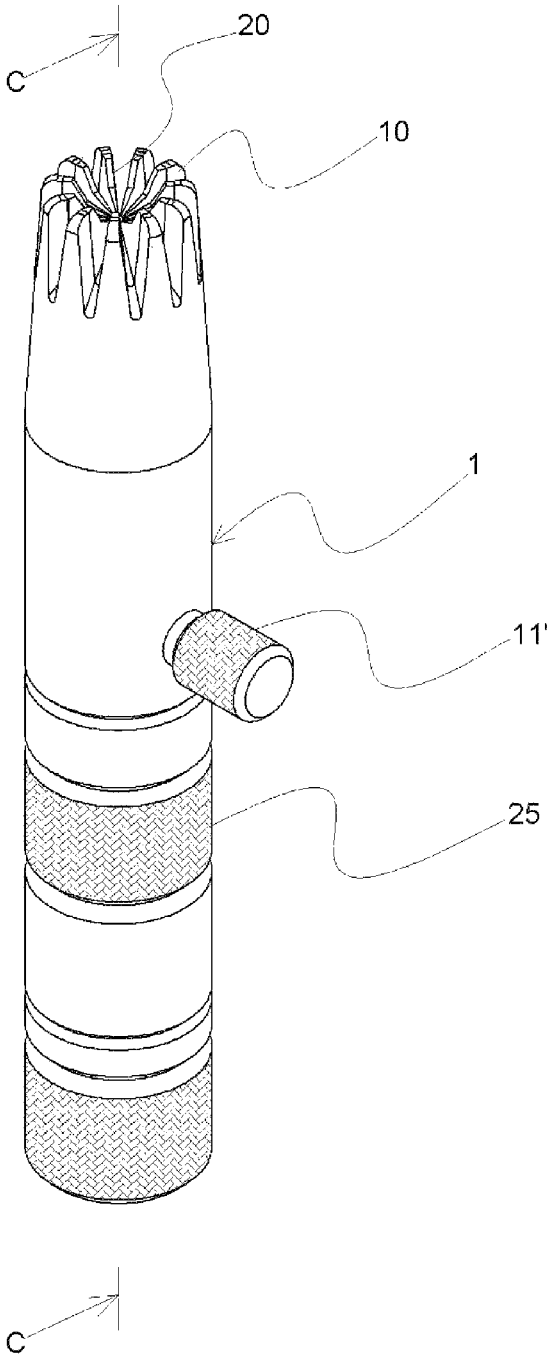
FIG. 1 is a perspective view illustrating a nose hair clipper disclosed in Korean Patent No. 1795626.
Figure 2:
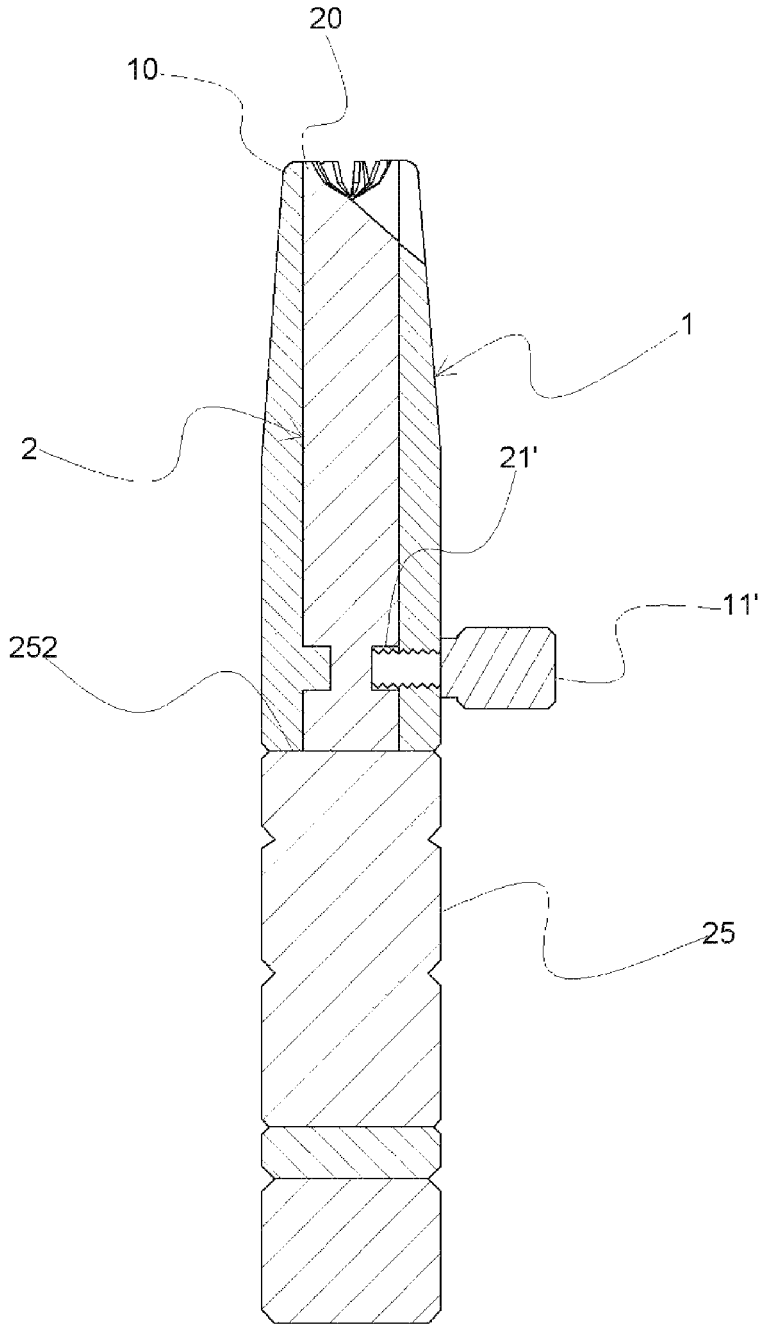
FIG. 2 is a cross-sectional view taken along line C-C in FIG. 1.
Figure 3:
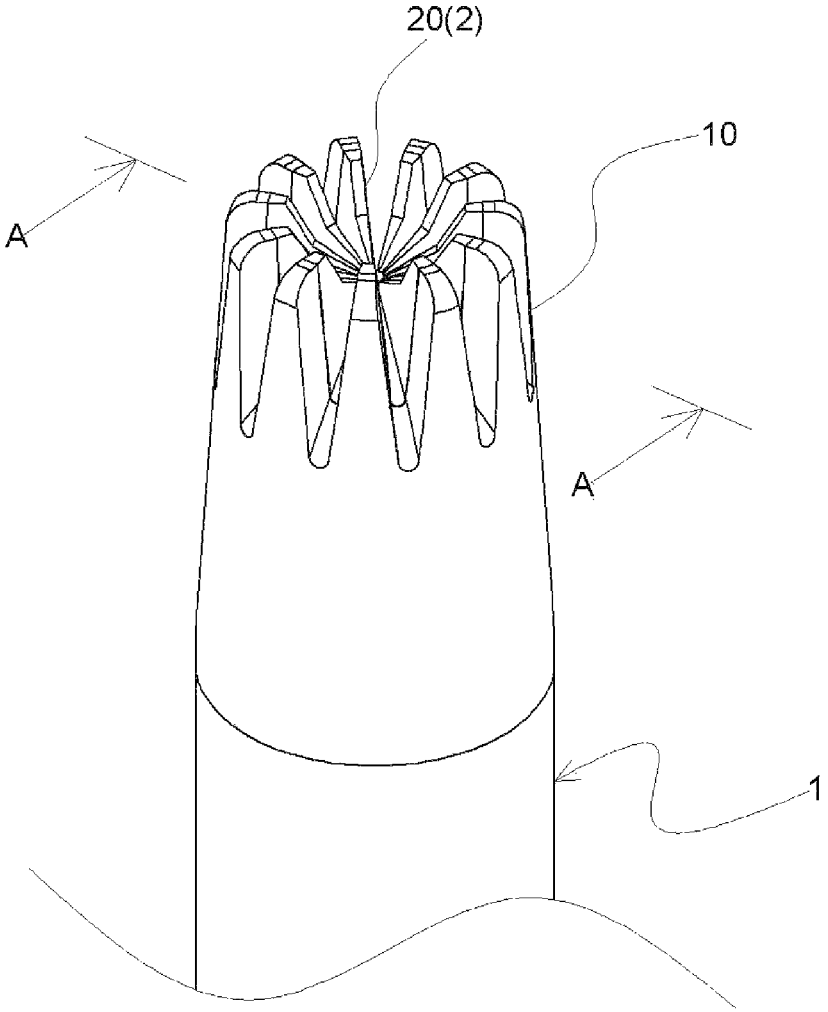
FIG. 3 is a perspective view illustrating internal and external cutting portions.
Figure 4:
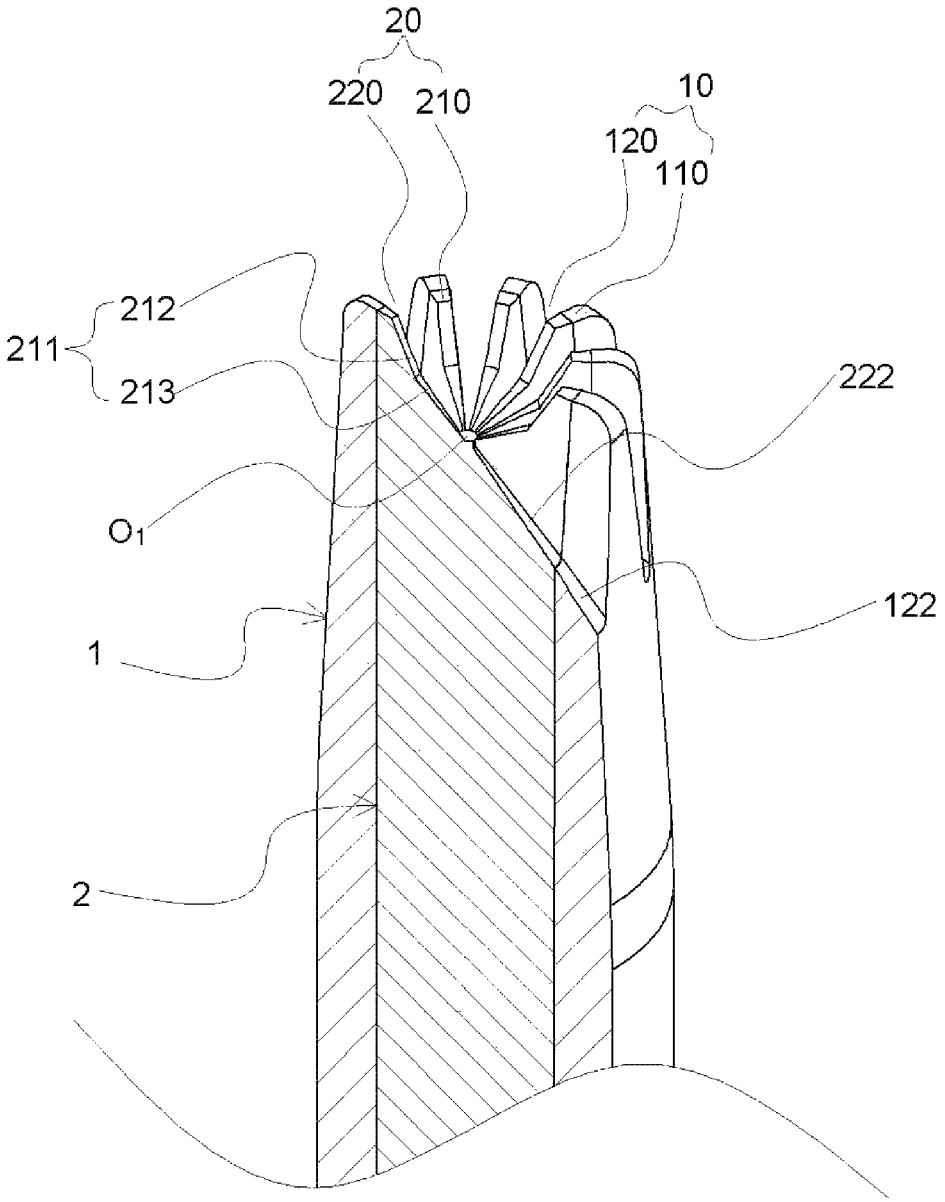
FIG. 4 is a cross-sectional view taken along line A-A in FIG. 3.
Figure 5:
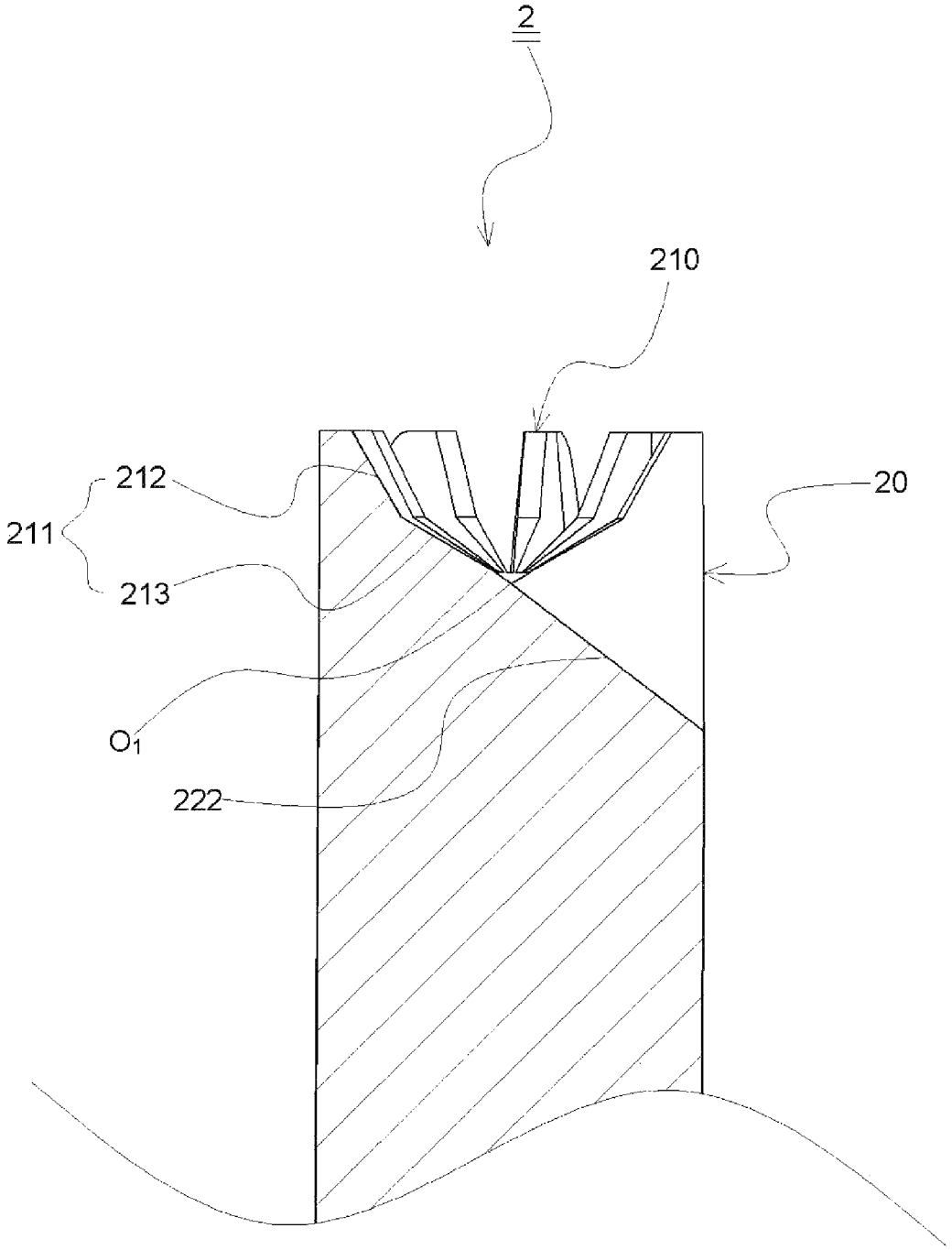
FIG. 5 is a cross-sectional view illustrating the internal cutting portion of a rotatable internal cylindrical body.

As illustrated in FIGS. 1 and 2, in a nose hair clipper that is manufactured in the form of a cylinder, a rotatable internal cylindrical body 2 having an internal cutting portion 20 is inserted into a stationary external cylindrical body 1 having an external cutting portion 10. A lower end of the stationary external cylindrical body 1 is fittingly nested on a circumferential portion 252 of an upper end of a handling body 25 integrally formed on a lower end of the rotatable internal cylindrical body 2. A leading end portion of a bolt 11' is screwed through the stationary external cylindrical body 1 into a circumferential concave groove 21'.

Therefore, when a user rotates the handling body 25 with his/her one hand while holding the stationary external cylindrical body 1 with his/her other hand, the rotatable internal cylindrical body 2 is rotated relatively to the stationary external cylindrical body 1. As a result, nose hairs are cut by the external cutting portion 10 of the stationary external cylindrical body 1 and the internal cutting portion 20 of the rotatable internal cylindrical body 2.

As illustrated in FIGS. 3 to 6, the rotatable internal cylindrical body 2 having the internal cutting portion 20 is inserted into the stationary external cylindrical body 1 having the external cutting portion 10, and thus the internal cutting portion 20 of the rotatable internal cylindrical body 2 is arranged in a manner that corresponds to the external cutting portion 10 of the stationary external cylindrical body 1.

The external cutting portion 10 is configured with a plurality of first cutting edges 110 and a plurality of first slits 120. The plurality of first cutting edges 110 and the plurality of first slits 120 are formed circumferentially in an alternating manner on an upper end of the stationary external cylindrical body 1.

The internal cutting portion 20 is configured with a plurality of second cutting edges 210 and a plurality of second slits 220. The plurality of second cutting edges 210 and the plurality of second slits 220 are formed circumferentially in an alternating manner on an upper end of the rotatable internal cylindrical body 2.

In addition, the rotatable internal cylindrical body 2 is rotated relatively to the stationary external cylindrical body 1 in a state where the first cutting edge 110 of the external cutting portion 10 and the second cutting edge 210 of the internal cutting portion 20 are positioned in such a manner as to horizontally overlap each other and where the first slit 120 of the external cutting portion 10 and the second list 220 of the internal cutting portion 20 are positioned in such a manner as to horizontally overlap each other. Thus, the nose hairs are cut by the plurality of first cutting edges 110 and the plurality of second cutting edges 210.

At this point, the second cutting edge 210 and the second slit 220 are arranged in such a manner as to face each other. An internal guidance portion 211 of the second cutting edge 210 is connected to a lower inclination surface 222 of the second slit at an apex $O_1$ of an approximately inverted cone-shaped hole. An upper end of a lower inclination surface 122 of the first slit 120 is positioned below a lower end of a lower inclination surface 222 of the second slit 220.

The internal guidance portion 211 includes a steep inclination portion 212 and a gentle inclination portion 213. The steep inclination portion 212 is steeply inclined downward from an upper end of the second cutting edge 210. The gentle inclination portion 213 is gently inclined downward from a lower end of the steep inclination portion 212 to the apex $O_1$ of the approximately inverted cone-shaped hole. The first cutting edge 110 of the external cutting portion 10 and the second cutting edge 210 of the internal cutting portion 20 are formed in a saw-toothed pattern.

Therefore, an upper end (leading end), through which the nose hairs start to be introduced, of the first slit 120 between the first cutting edges 110 are formed to have a greater width than a lower end thereof. Furthermore, an upper end (leading end), through which the nose hairs start to be introduced, of the second slit 220 between the second cutting edges 210 has a greater width than a lower end thereof. Thus, the nose hairs are guided toward the first slit 120 and the second slit 220.

Figure 6:
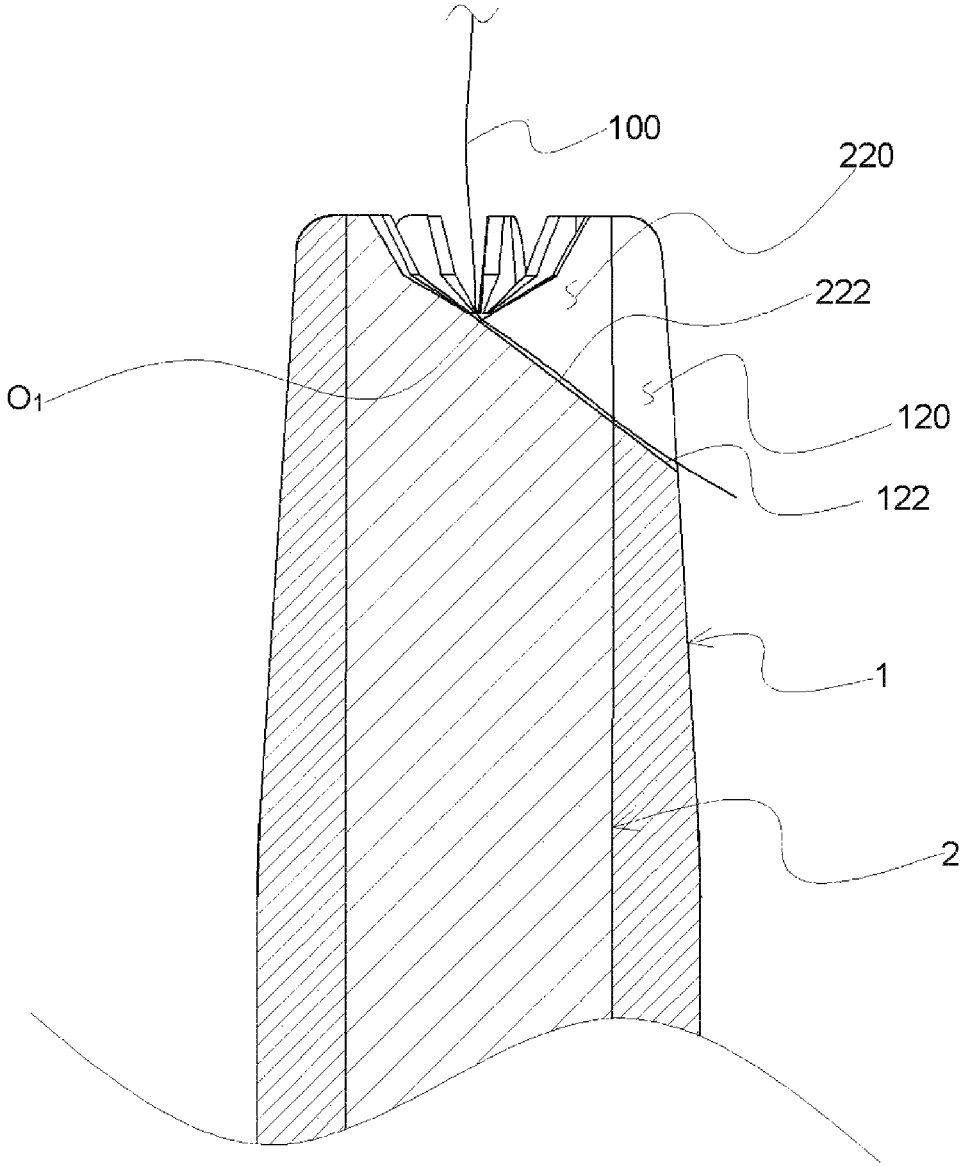
FIG. 6 is a cross-sectional view schematically illustrating an example where nose hairs are cut.
Figure 7:
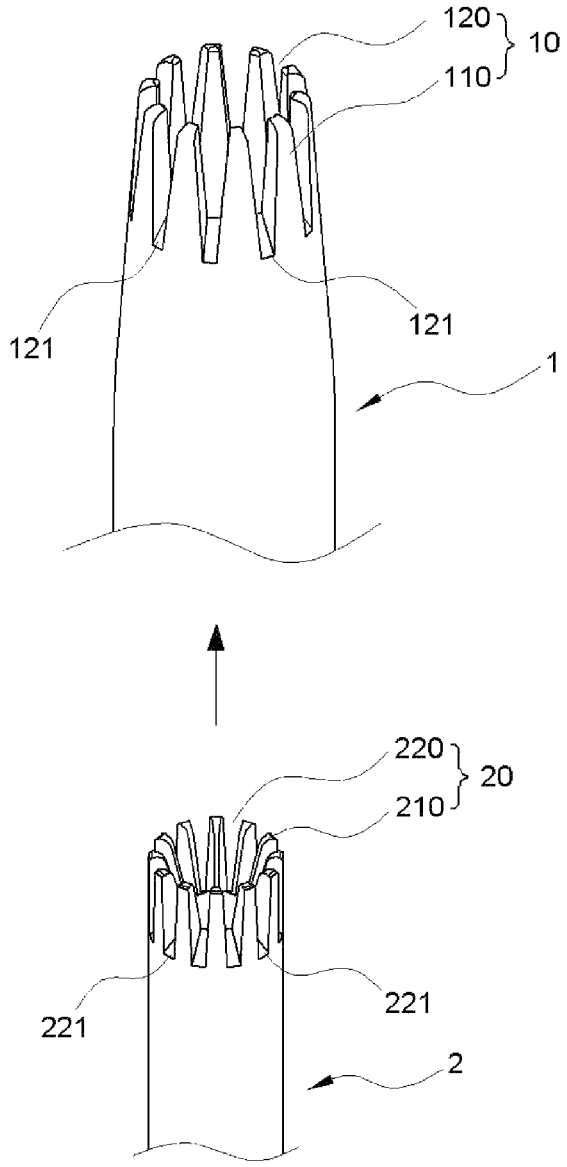
FIG. 7 is a perspective view illustrating external and internal cutting portions of improved stationary external and rotatable internal cylindrical bodies.
Figure 8:
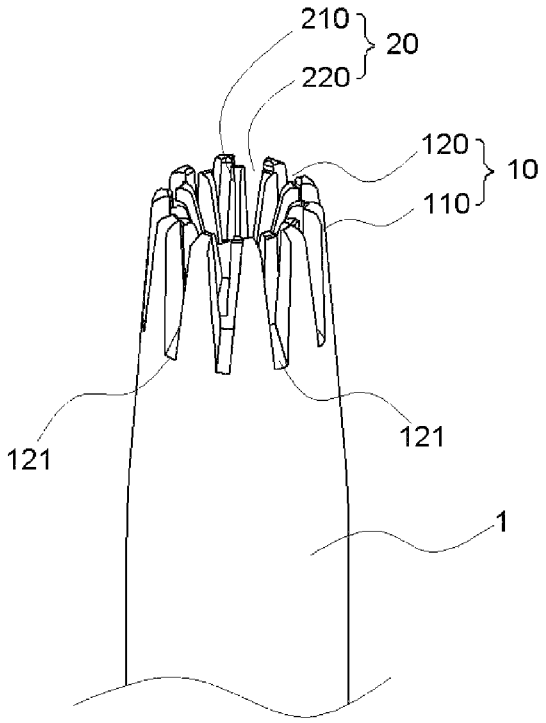
FIG. 8 is a perspective view illustrating a state where the rotatable internal cylindrical body in FIG. 7 is inserted into the stationary external cylindrical body in FIG. 7.
Figure 9A:
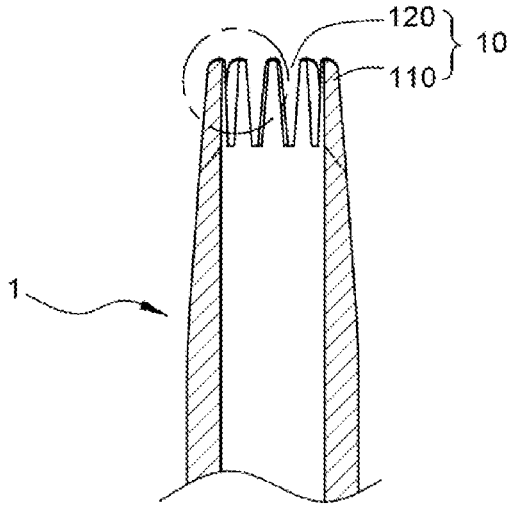
FIG. 9A is a cross-sectional view of the external cutting portion.
Figure 9B:
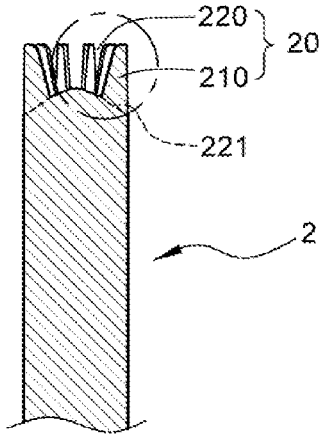
FIG. 9B is a cross-sectional view of the internal cutting portion.
Figure 9C:
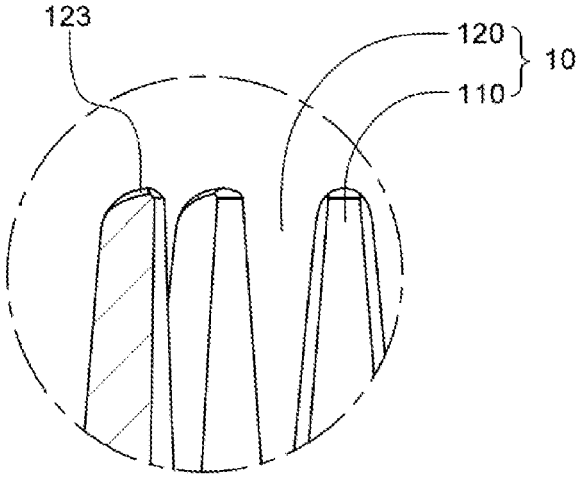
FIG. 9C is an enlarged cross-sectional view of the external cutting portion of FIG. 9A.
Figure 9D:
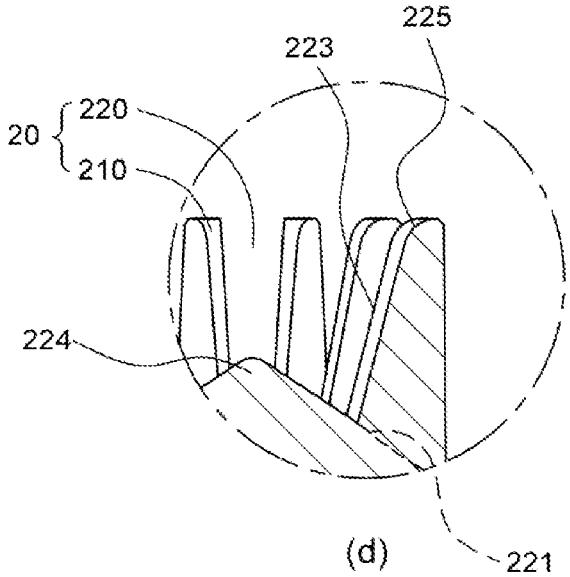
FIG. 9D is an enlarged cross-sectional view of the internal cutting portion of FIG. 9C.
Figure 10:
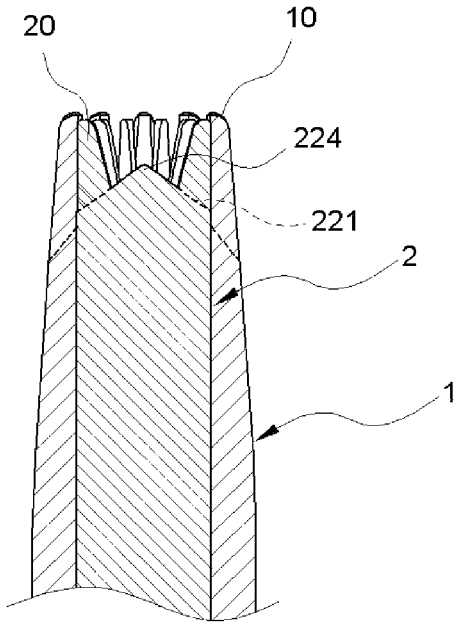
FIG. 10 is a cross-sectional view illustrating a state where the rotatable internal cylindrical body is inserted into the stationary external cylindrical body.
Figure 11:
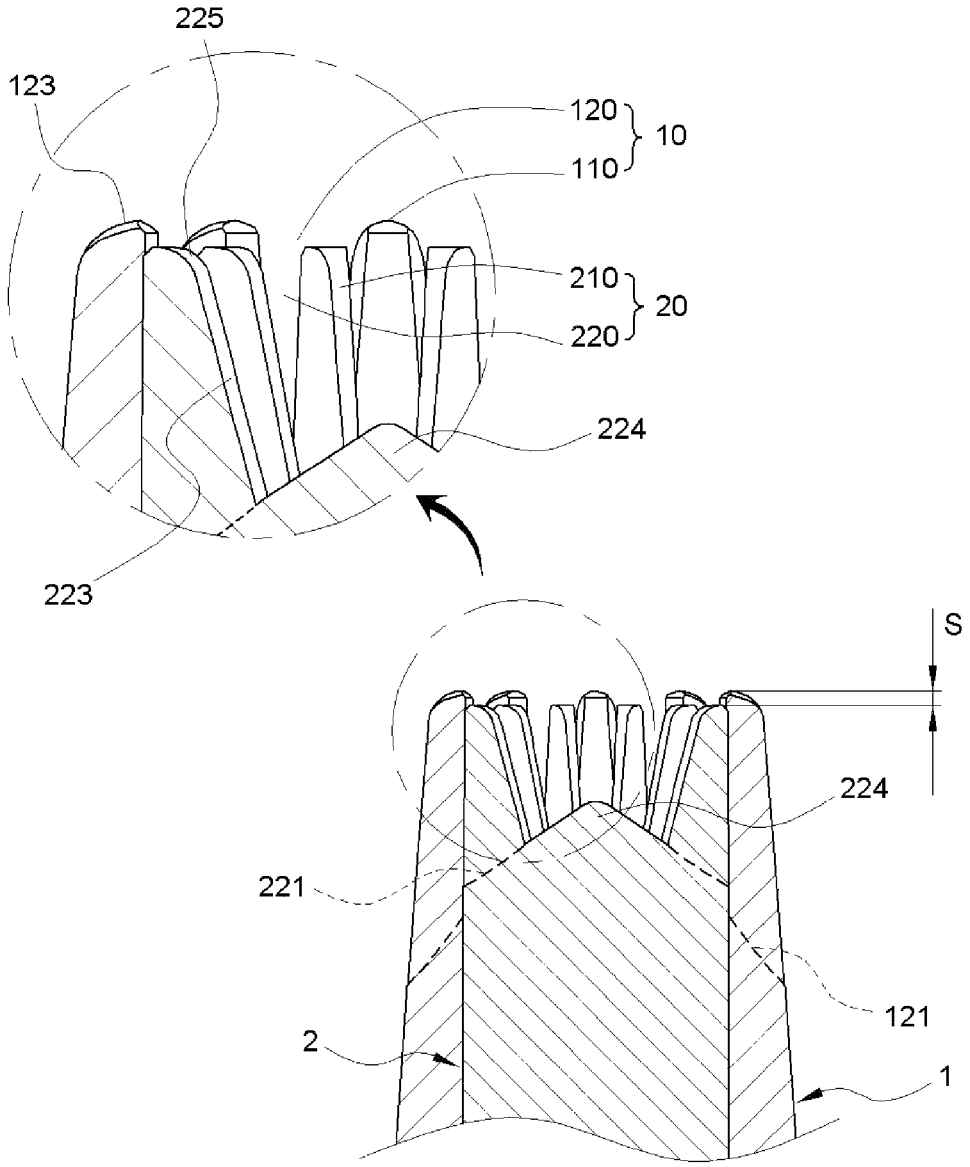
FIG. 11 is an enlarged cross-sectional view illustrating the external and internal cutting portions.
Figure 12:
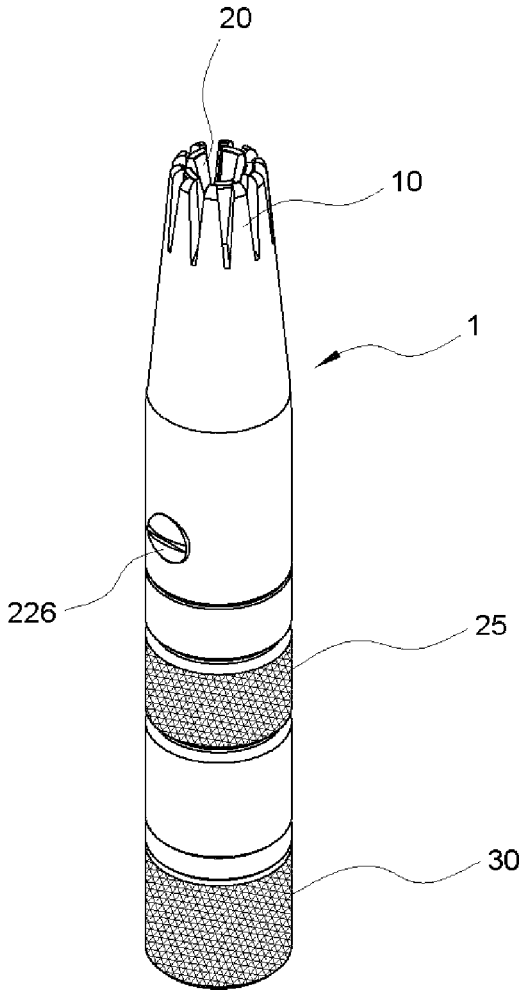
FIG. 12 is a perspective view of an improved nose hair clipper.
Figure 13:
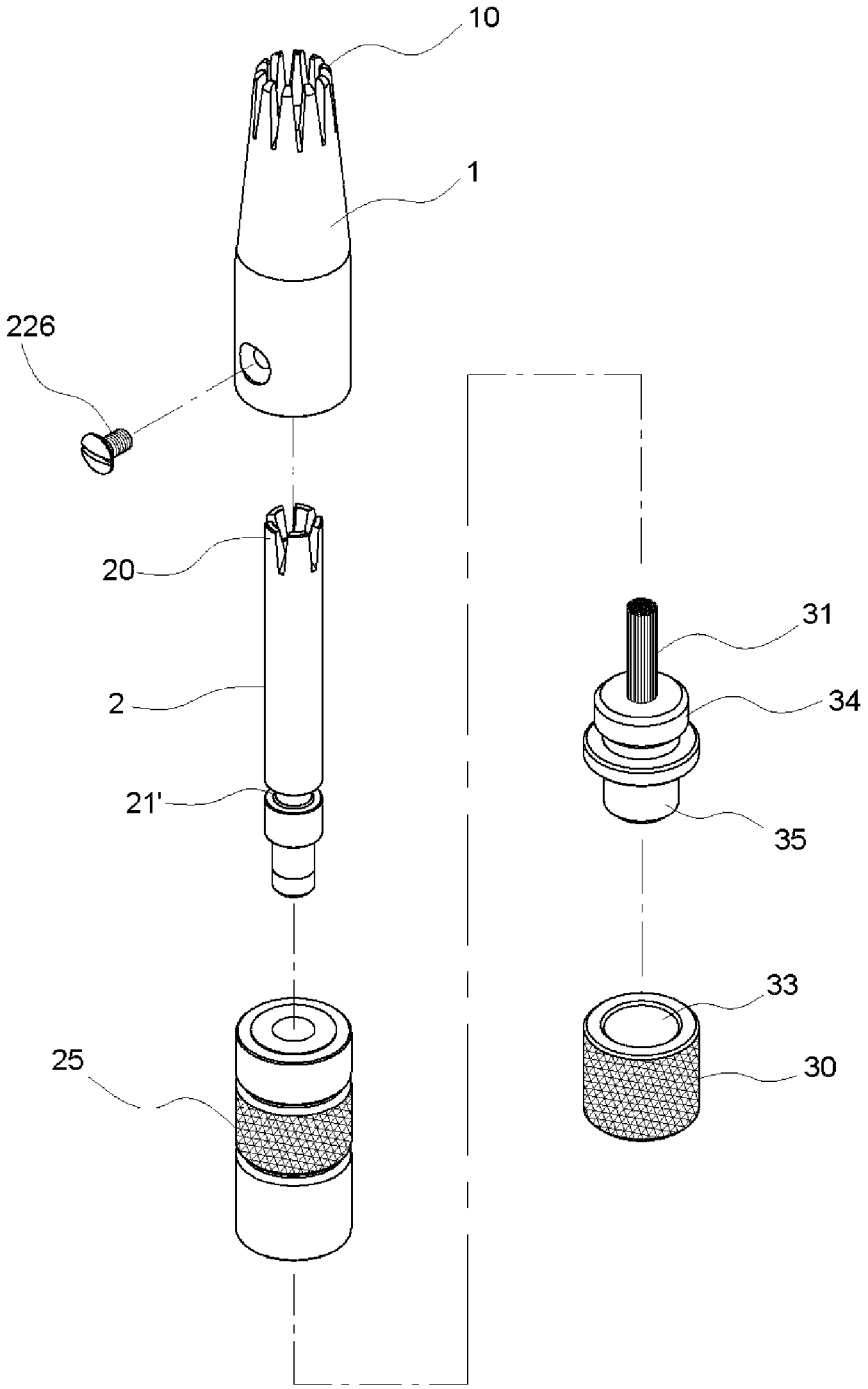
FIG. 13 is an exploded perspective view illustrating the improved nose hair clipper in FIG. 12.
Figure 14:
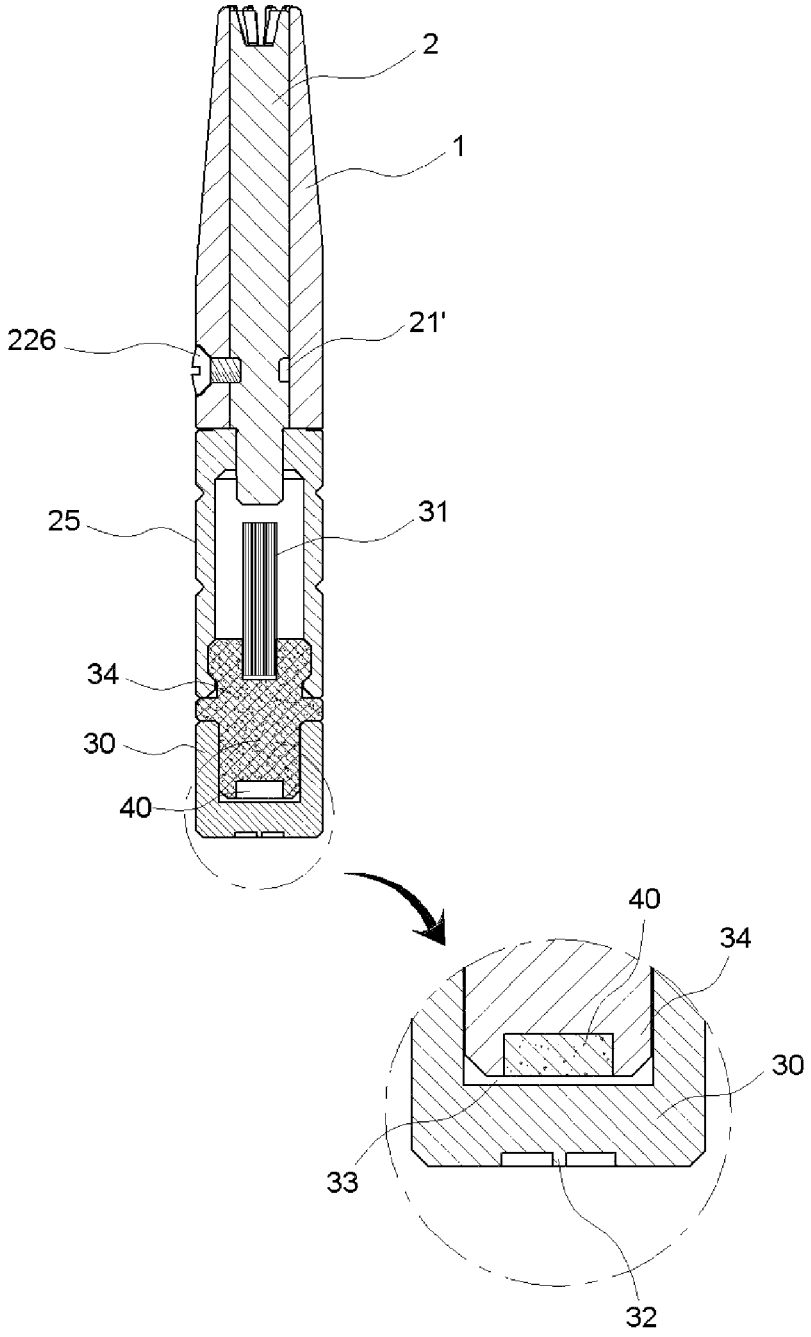
FIG. 14 is a cross-sectional view illustrating the configuration of the improved nose hair clipper in FIG. 12.
Figure 15A:
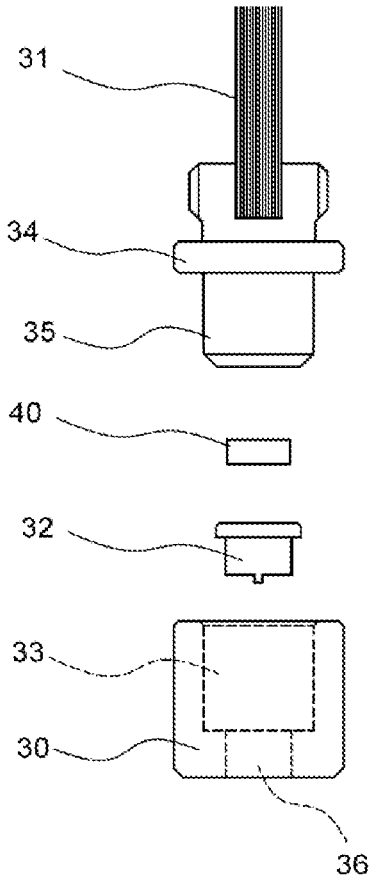
FIG. 15A is an exploded front view illustrating a configuration of an auxiliary cap.
Figure 15B:
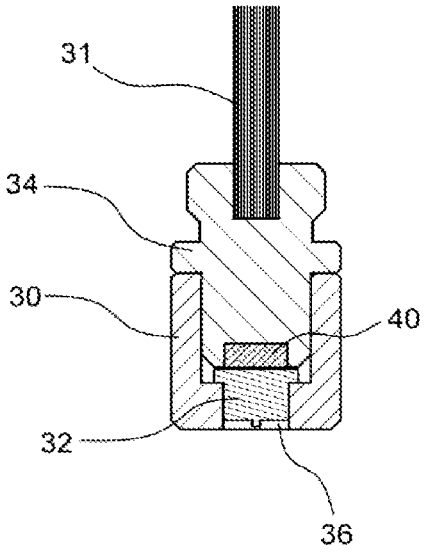
FIG. 15B is a cross-sectional view illustrating a state where components of the auxiliary cap of FIG. 15A are assembled.
Figure 16:
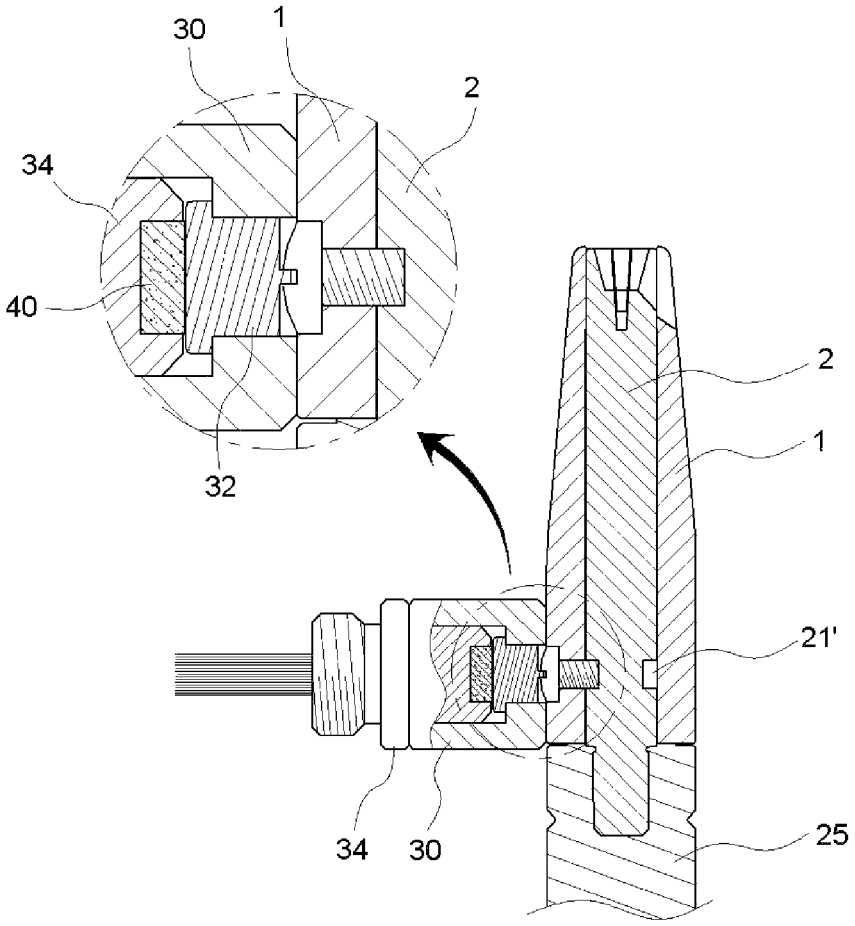
FIG. 16 is a cross-sectional view illustrating the configuration of an example where the auxiliary cap is used.

That is, as illustrated in FIG. 6, the plurality of second cutting edges 210 of the internal cutting portion 20 of the rotatable internal cylindrical body 2 are formed inward around the approximately inverted cone-shaped positioned inside the bowl-shaped hole. Thus, nose hairs 100, after introduced into the approximately inverted cone-shaped hole, are bent at the apex $O_1$ of the approximately inverted cone-shaped hole and then are guided toward the lower inclination surface 222 of the second slit 220.

Moreover, through the lower inclination surface 222 of the second slit 220, the nose hairs 100 introduced into the approximately inverted cone-shaped hole are guided toward the lower inclination surface 122 of the first slit 120. When the rotatable internal cylindrical body 2 is rotated relatively to the stationary external cylindrical body, the nose hairs 100 are cut by the first cutting edge 110 and the second cutting edge 210.

However, in some cases, the nose hair clipper described above, when actually in use, frequently does not cut the nose hairs 100.

That is, the nose hairs are difficult to introduce into the approximately inverted cone-shaped hole in the rotatable internal cylindrical body 2 because the external cutting portion 10 formed on the upper leading end of the stationary external cylindrical body 1 and the internal cutting portion 20 formed on the upper leading end of the rotatable internal cylindrical body 2 are arranged in the same position. Thus, the nose hairs 100 are difficult to cut. Moreover, an upper leading end portion of the stationary external cylindrical body is angular, and thus a lower end portion of the inclination surface is formed narrowly. Thus, the nose hairs 100 are not introduced at one time into the approximately inverted cone-shaped hole. This repulses the user.

In addition, while the nose hairs 100 introduced into the approximately inverted cone-shaped hole in the rotatable internal cylindrical body 2 are guided toward the external cutting portion 10 of the stationary external cylindrical body 1 through the lower inclination surface 222 of the second slit 220, the nose hairs 100 are concentrated in the center portion of the rotatable internal cylindrical body 2. Therefore, the nose hairs 100 are not easy to guide. In some cases, the nose hairs 100 are not cut due to a deviation from the stationary external cylindrical body 1.

Moreover, the stationary external cylindrical body 1 and the rotatable internal cylindrical body 2 are configured to be connected to and disconnected from each other with a protruding-type bolt. Thus, the appearance of the nose hair clipper is spoiled. Furthermore, the inconvenience is caused when the nose hair clipper is in use. In order to clean the nose hair clipper after use, the stationary external cylindrical body 1 and the rotatable internal cylindrical body 2 have to be completely disconnected from each other using the bolt, thereby causing inconvenience to the user.

The inventor has developed a nose hair clipper with a structure that is modified in a novel way through much research and experiment, considering the problems described above.

FIGS. 7 to 11 illustrate a nose hair clipper in which optimal improvements are made to structures of the external and internal cutting portions 10 and 20 to be formed on a normal stationary external cylindrical body 1 and a normal rotatable internal cylindrical body 2, respectively. The same constituent elements are given the same reference character, and the same description thereof is not repeated.

An external cutting portion 10 formed circumferentially on an upper end of a stationary external cylindrical body 1 is configured with a plurality of first cutting edges 110 and a plurality of first slits 120. An internal cutting portion 20 formed circumferentially on an upper end of a rotatable internal cylindrical body 2 is configure with a plurality of second cutting edges 210 and a plurality of second slits 220.

Accordingly, the rotatable internal cylindrical body 2 is rotated relatively to the stationary external cylindrical body 1 in a state where each of the plurality of first cutting edges 110 of the external cutting portion 10 and each of the plurality of second cutting edges 210 of the internal cutting portion 20 are positioned in such a manner as to horizontally overlap each other and where each of the plurality of first slits 120 and each of the plurality of second slits 220 are positioned in such a manner as to horizontally overlap each other. Nose hairs are cut by the plurality of first cutting edges 110 and the plurality of second cutting edges 210.

The first cutting edge 110 and the first slit 120 of the external cutting portion 10 are arranged in such a manner as to face each other, and a lower inclination surface 121 is formed in a manner that is linearly connected to the first slit 120. The second cutting edge 210 and the second slit 220 of the internal cutting portion 20 are arranged in such a manner as to face each other, and a lower inclination surface 221 is formed in a manner that is linearly connected to the second slit 220.

An internal inclination surface 223 of the second cutting edge 210 is formed in a manner that is linearly connected to a surface of the convex portion 224 formed upward from a bottom of the internal cutting portion 20.

In addition, a plurality of rounded portions 123 are formed on an upper leading end of the external cutting portion 10 formed on the stationary external cylindrical body 1. Therefore, the nose hairs are easier to introduce into a groove than in a case where an upper end portion of the stationary external cylindrical body 1 is angular. This does not inspire the user with the feeling of repulsion.

In addition, the plurality of rounded portions 123 of the external cutting portion 10 of the stationary external cylindrical body 1 extends upward to be higher than an upper leading end of the internal cutting portion 20 of the rotatable internal cylindrical body 2 by a predetermined gap S. It is preferable that the predetermined gap S is approximately 0.35 to 0.45 mm.

Accordingly, the nose hairs are easy to cut at a distance, corresponding to the predetermined gap S, away from the user's skin. Unlike in the previously employed structure, the external and internal cutting portions 10 and 20 formed on the upper leading ends, respectively, of the stationary external cylindrical body 1 and the rotation internal cylindrical body 2 are not arranged in the same position. Thus, a phenomenon where the nose hairs are cut at a short distance away from the user's skin can be prevented.

The upper leading end and the internal inclination surface 223 of the internal cutting portion 20 constituting the rotatable internal cylindrical body 2 are linearly connected between rounded portion 225 interposed therebetween. A lower inclination surface 121 formed on the first slit 120 in the external cutting portion 10 and a lower inclination surface 221 formed on the second slit 220 in the internal cutting portion 20 are arranged below the convex portion 224 of the internal cutting portion 20.

Therefore, the nose hairs are guided toward the convex portion 224 through the second slit 220, and are cut more reliably by the first cutting edges 110 and the second cutting edges 210 as if they were cut by scissors.

It is illustrated that the convex portion 224 is formed upward from the bottom of the internal cutting portion 20. However, a concave portion 224 may be formed upward from the bottom of the internal cutting portion 20.

In addition, since the predetermined gap S is present between the respective upper leading ends of the stationary external cylindrical body 1 and the rotatable internal cylindrical body 2, the nose hairs are first blocked by an internal surface of the groove in the stationary external cylindrical body 1, and thus go down. Subsequently, when the rotatable internal cylindrical body 2 is rotated, the nose hairs are cut more smoothly than in the previously employed structure.

It is most preferable that the number of the first slits 120 in the stationary external cylindrical body 1 is limited to 12 and that the number of the second slits 220 in the rotatable internal cylindrical body 2 is limited to 9. Thus, the optimal performance in cutting the nose hairs can be ensured.

FIGS. 12 to 16 illustrate a nose hair clipper in which an improvement is made to the structure of the handling body thereof. The same constituent elements are given the same reference character, and the same description thereof is not repeated.

A bolt 226 serves to fasten the stationary external cylindrical body 1 and the rotatable internal cylindrical body 2 that constitute the nose hair clipper, to each other. A configuration is employed in which the bolt 226 does not protrude from a circumferential surface of the stationary external cylindrical body 1 and in which the bolt 226 is screwed through the stationary external cylindrical body 1 into a circumferential concave groove 21'. Thus, the appearance of the nose hair clipper is not spoiled, and the inconvenience is not caused to the user.

In addition, an auxiliary cap 30 is removably attached, by a screw engagement manner, to a lower end of the handling body 25. The auxiliary cap 30 includes a brush 31 and a driver 32.

That is, an insertion hole 33 is formed in the auxiliary cap 30. The brush 31 is integrally buried in a cylindrical body 34 of the auxiliary cap 30. The cylindrical body 34 is held by inserting an insertion portion 35 formed on a lower end portion of the cylindrical body 34 into the insertion hole 33. The driver 32 is formed in a center portion of a bottom surface of the auxiliary cap 30. With the driver, the bolt is screwed and unscrewed to connect and disconnect the stationary external cylindrical body 1 to and from the rotatable internal cylindrical body 2.

Accordingly, the auxiliary cap 30 is utilized when the stationary external cylindrical body 1 is completely separated from the rotatable internal cylindrical body 2 for cleaning and is connected back thereto after cleaning.

In addition, a permanent magnet 40 may be buried in a lower portion of the cylindrical body 34. With a magnetic force of the permanent magnet 40, the bolt 226 can be kept attached to the auxiliary cap 30. Thus, the bolt 226 does not fall off from the nose hair clipper.

The driver 32 is formed in the center portion of the bottom surface of the auxiliary cap 30 by forming grooves in the center portion thereof. However, a driver 32 that is separately manufactured may be inserted into a through-hole 36 formed in the auxiliary cap 30.

A described above, in the nose hair clipper according to the present disclosure, the rounded portion is formed on the upper leading end of the stationary external cylindrical body constituting a main body of the nose hair clipper. Thus, the nose hairs are easier to introduce at one time into the groove than in the previously employed structure in which the upper end portion of the stationary external cylindrical body 1 is angular. This does not inspire the user with the feeling of repulsion.

In addition, the upper leading end of the stationary external cylindrical body 1 is formed to be positioned by the predetermined gap S at a higher height than the upper leading end of the internal cutting portion 20 formed in the rotatable internal cylindrical body 2. Accordingly, the nose hairs are first blocked by the internal surface of the groove and thus go down. Subsequently, the nose hairs are introduced toward a curved portion. A lower end portion of the inclination surface is formed relatively widely, and thus the nose hairs are cut smoothly.

Moreover, the bolt 226 fastening the stationary external cylindrical body 1 and the rotatable internal cylindrical body 2 to each other does not protrude from the circumferential surface of the stationary external cylindrical body 1. Thus, the appearance of the nose hair clipper is not spoiled. Furthermore, while the nose hair clipper is in use, the inconvenience is not caused to the user. The auxiliary cap including the brush and the driver is mounted on the lower end of the handling body of the nose hair clipper. Thus, the stationary external cylindrical body 1 can be easily separated from the rotatable internal cylindrical body 2 when the cutting portions 10 and 20 need to be cleaned or whenever necessary for any other reason.

Although the specific embodiment of the present disclosure has been described for illustrative purposes, those skilled in the art will appreciate that various modifications, additions, and substitutions are possible, without departing from the scope and spirit of the disclosure as disclosed in the accompanying claims.

What is claimed is:

1. A nose hair clipper comprising:

a stationary external cylindrical body (1) having an external cutting portion (10) and a rotatable internal cylindrical body (2) having an internal cutting portion (20), the external cutting portion (10) being formed circumferentially on an upper end of the external cylindrical body (1) and having a plurality of first cutting edges (110) and a plurality of first slits (120), and the internal cutting portion (20) being formed circumferentially on an upper end of the internal cylindrical body (2) and having a plurality of second cutting edges (210) and a plurality of second slits (220), wherein the internal cylindrical body (2) is inserted into the external cylindrical body (1) such that the external cutting portion (10) and the internal cutting portion (20) correspond to each other, and when the internal cylindrical body (2) is rotated relative to the external cylindrical body (1) in a state in which the first cutting edges (110) and the first slits (120) of the external cutting portion (10) are aligned with the second cutting edges (210) and the second slits (220) of the internal cutting portion (20), respectively, nose hairs are cut by the first cutting edges (110) and the second cutting edges (210), wherein the external cutting portion (10) of the stationary external cylindrical body (1) has a plurality of rounded portions (123) on an upper leading end thereof, the plurality of rounded portions (123) extending upward to be higher than an upper leading end of the internal cutting portion (20) of the rotatable internal cylindrical body (2) by a predetermined gap (S), the second cutting edges (210) and the second slits (220) of the internal cutting portion (20) are arranged in such a manner as to face each other, and internal inclination surfaces (223) of the second cutting edges (210) are linearly connected to a surface of a convex portion (224) formed upward from a bottom of the internal cutting portion (20), lower inclination surfaces (122) of the plurality of first slits (120) in the external cutting portion (20) are arranged below the convex portion (224) of the internal cutting portion (20), so that nose hairs are introduced through the plurality of second slits (220), are guided toward the convex portion (224), and, when the rotatable internal cylindrical body (20) is rotated, the nose hairs are cut by the plurality of first cutting edges (110) and the plurality of the second cutting edges (210), a bolt (226) is screwed through the stationary external cylindrical body (1) into a circumferential concave groove (21') of the rotatable internal cylindrical body (2) to fasten the stationary external cylindrical body (1) and the rotatable internal cylindrical body (2) to each other, the bolt (226) being buried in the stationary external cylindrical body (1) without protruding from a circumferential surface thereof, and an auxiliary cap (30) having a brush (31) and a driver (32) is connected by a screw engagement manner to a lower end of a handling body (25) formed on a lower end of the rotatable internal cylindrical body (2).

2. The nose hair clipper of claim 1, wherein the number of the plurality of first slits (120) in the stationary external cylindrical body (1) is 12, and the number of the plurality of second slits (220) in the rotatable internal cylindrical body (2) is 9, and wherein the upper leading end and the internal inclination surfaces (223) of the internal cutting portion (20) constituting the rotatable internal cylindrical body (2) are linearly connected with a rounded portion (225) interposed therebetween.

3. The nose hair clipper of claim 1, wherein the brush (31) is integrally buried in the auxiliary cap (30), a cylindrical body (34) on which an insertion portion (35) is formed is held by being inserted into the auxiliary cap (30), and the driver (32) is held by being inserted into a through-hole (36) formed in a center portion of a bottom surface of the auxiliary cap (30).

4. The nose hair clipper of claim 3, wherein a permanent magnet (40) is buried in a lower portion of the cylindrical body (34).

* * * * *